US006333597B1

(12) United States Patent
Mitomo

(10) Patent No.: US 6,333,597 B1
(45) Date of Patent: Dec. 25, 2001

(54) PLASMA DISPLAY PANEL WITH COLOR FILTER LAYERS

(75) Inventor: Hiroyuki Mitomo, Yamanashi-ken (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/201,125

(22) Filed: Nov. 30, 1998

(30) Foreign Application Priority Data

Nov. 28, 1997 (JP) ..... 9-344344
Feb. 25, 1998 (JP) ..... 10-060555

(51) Int. Cl.[7] ..... H01J 17/49; H01J 61/40
(52) U.S. Cl. ..... 313/489; 586/587
(58) Field of Search ..... 313/110, 112, 313/580, 586, 585, 587, 489, 491; 359/885; 428/428

(56) References Cited

U.S. PATENT DOCUMENTS 4,741,963 * 5/1988 Wada et al. ..... 428/428
5,654,727 * 8/1997 Lepselter ..... 313/491
5,838,105 * 11/1998 Mitomo ..... 313/582
5,838,106 * 11/1998 Funada ..... 313/587
5,952,782 * 9/1999 Nanto et al. ..... 313/584

FOREIGN PATENT DOCUMENTS 10-27550 * 1/1998 (JP) ..... H01J/11/02

* cited by examiner

*Primary Examiner*—Michael H. Day
(74) *Attorney, Agent, or Firm*—Arent Fox Kintner Plotkin & Kahn, PLLC

(57) ABSTRACT

A plasma display panel includes a front substrate plate providing a display surface; a plurality of row electrode pairs formed on an inner surface of the front substrate plate; a dielectric layer formed on the plurality of row electrode pairs; a protection layer formed on the dielectric layer; a rear substrate plate spaced apart from the front substrate plate with a discharge space formed therebetween; a plurality of column electrodes formed on an inner surface of the rear substrate layer and arranged in a direction orthogonal to the row electrode pairs; a plurality of elongated partitions disposed between the plurality of column electrodes; a plurality of elongated fluorescent layers covering the column electrodes and side walls of the elongated partitions; a plurality of color filter layers formed on the inner surface of the front substrate plate. The color filter layers are inorganic pigment layers patterned in a manner such that one or more unit luminescent areas contains one of the color filter layers just like an isolated island.

3 Claims, 8 Drawing Sheets

PLASMA DISPLAY PANEL WITH COLOR FILTER LAYERS

BACKGROUND OF THE INVENTION

The present invention relates to a plasma display panel, in particular to a surface discharge type plasma display panel.

Recently, there has been a demand that a surface discharge type plasma display panel be put into actual use, i.e., for use as a color display device which is large in size but small in thickness. FIG. 10 is a plane view schematically illustrating the structure of a conventional surface discharge type plasma display panel. FIG. 11 is a cross sectional view, taken along line V—V in FIG. 10, schematically indicating the internal structure of the plasma display panel of FIG. 10.

Referring to FIG. 10, the conventional plasma display panel has a plurality of row electrode pairs 2,2, each arranged along a display line L of a matrix array on the panel, in a manner such that each electrode pair 2,2 has a discharge gap 11 formed therebetween. Further, along each display line L, there are formed several unit luminescent areas, each of which forms a picture element cell (discharge sell).

FIG. 11 is used to illustrate some important portions of the conventional display panel of FIG. 10. As shown in FIGS. 10 and 11, formed on the inner surface of a front glass substrate 1 (serving as a front display plate), are a plurality of strap-like inorganic pigment layers 41 forming color filter layers corresponding to a plurality of elongated fluorescent layers 7 involving various colors, a transparent overcoat 42 covering the inorganic pigment layers 41, a plurality of row electrode pairs 2,2, a dielectric layer 3 covering the row electrode pairs 2,2, a protection layer 4 consisting of MgO covering the dielectric layer 3.

Each row electrode 2 includes a transparent electrode 2*a* consisting of a strap-like transparent conductive film of ITO having a relatively large width, and a metal electrode (bus electrode) 2*b* consisting of a metal film having a relatively small width. The metal electrode 2*b* is used to supplement the conductivity of the transparent electrode 2*a*.

On the other hand, a rear glass substrate 5 is positioned spaced apart from the front glass substrate 1 so that a discharge space 8 is formed between the two substrates. As shown in FIG. 11, a plurality of column electrodes 6 are provided on the inner surface of the rear glass substrate 5 in a manner such that they are all orthogonal to the row electrode pairs 2,2. In fact, intersections of the row electrode pairs 2,2 with the column electrodes 6 form picture element cells. Further, a plurality of strap-like partitions 9 are provided between the column electrodes 6, so that the discharge space 8 is divided into several sections. Inaddition, a plurality of elongated fluorescent layers 7 are disposed in the discharge space 8 to cover the column electrodes 6 and side walls of the partitions 9. Finally, after a noble gas is sealed into the discharge space 8, a desired surface discharge type plasma display panel is thus formed.

In use of the surface discharge type plasma display panel constructed in the above prior art, at first, an addressing process is conducted by selective discharge between the column electrodes 6 and the row electrodes 2, so as to select lighting cells (in which wall charges are formed) and not-lighting cells (in which wall charges are not formed). After the addressing process, by alternatively applying discharge maintaining pulses to the row electrode pairs 2,2 on all the display lines L, a surface discharge will occur every time the discharge maintaining pulses are applied to the lighting cells. Then, with the effect of the surface discharge, an ultraviolet light will occur, so that the fluorescent layer 7 will be excited, thereby producing a visible light.

Conventionally, in order to improve a contrast and a color fineness of a surface discharge type plasma display panel, a plurality of strap-like inorganic pigment layers 41 forming color filter layers are usually provided on the inner surface of the front glass substrate 1. As a method for forming the inorganic pigment layers 41, it has been suggested that such inorganic pigment layers 41 be formed on the inner surface of the front glass substrate 1 by way of screen printing. With the use of this method, since the color filter layers 41 may be made into a small thickness having only several microns, it is allowed to reduce surface irregularities possibly caused by the color filter layers.

However, since the strap-like inorganic pigment layers 41 are only attached on to the inner surface of the front glass substrate 1, they are likely to peel off during a process when the row electrodes 2 are being formed with the use of a photolithograph method. In order to cope with such problem, there has been suggested another method in which an amount of low melting point glass paste is applied to the surfaces of strap-like inorganic pigment layers 41 and also applied to the exposed surface areas on the inner surface of the front glass substrate 1, followed by a baking treatment, so as to form an overcoat layer 42 consisting of a transparent material which is useful to firmly fix the inorganic pigment layers 41 on the inner surface of the front glass substrate 1.

But, one problem with the above second method is that it is difficult for the overcoat layer material to sufficiently penetrate into and through the inorganic pigment layers 41, and another problem is that since the inorganic pigment layers 41 are disposed between the front glass substrate 1 and the overcoat layer 42, the effective areas (between the strap-like inorganic pigment layers 41) useful for bonding the overcoat layer 42 with the front glass substrate 1 are not enough. As a result, it is likely that some defects such as pin holes and/or cracks will occur on the overcoat layer 42, causing the overcoat layer 42 to peel off, resulting in a problem that during a photolithograph process for forming row electrodes 2, a treatment liquid will invade into the inorganic pigment layers 41, causing undesired color change thereon. In addition, since the effective areas (between the strap-like pigment layers 41) useful for bonding the overcoat layer 42 with the front glass substrate 1 are only narrow strap-like areas, the overcoat layer 42 has only a weak strength that is difficult to resist a possible stress. On the other hand, if the thickness of the overcoat layer 42 is increased in order to avoid the above problem, the overcoat layer 42 with a large thickness will have only a low light transmissivity. Moreover, if there are some deflections among strap-like inorganic pigment layers 41, the effective areas useful for bonding the overcoat layer 42 with the front glass substrate 1 will be reduced somehow, resulting a weak adherence between these two members.

FIGS. 12–14 are views schematically illustrating the structure of another conventional surface discharge type plasma display panel.

As shown in FIG. 12 which is a plane view, a plurality of row electrode pairs 2,2 are provided and arranged in a manner such that each pair forms a discharge gap G on each display line L. Along each display lineL, there are formed several unit luminescent areas each serving as a picture element cell (discharge sell), at intersections where the row electrodes 2 are intersected with column electrodes (not shown in FIG. 12).

FIG. 13 is a cross sectional view taken along line V—V in FIG. 12, schematically indicating the internal structure of the plasma display panel of FIG. 12. In fact, formed on the inner surface of a front glass substrate 1 (serving as a front display plate), are a plurality of strap-like inorganic pigment layers 41 (41R, 41G, 41B) forming color filter layers corresponding to a plurality of elongated fluorescent layers 7 (FIG. 14) involving various colors, a transparent overcoat 42 covering the inorganic pigment layers 41, a plurality of row electrode pairs 2,2, a dielectric layer 3 covering the row electrode pairs 2, 2, a protection layer 4 consisting of MgO for covering the dielectric layer 3.

Each row electrode 2 includes a transparent electrode 2*a* consisting of a strap-like transparent conductive film of ITO having a relatively large width, and a metal electrode (bus electrode) 2*b* consisting of a metal film having a relatively small width. The metal electrode 2*b* is used to supplement the conductivity of the transparent electrode 2*a*.

On the other hand, a rear glass substrate 5 is positioned spaced apart from the front glass substrate 1 so that a discharge space 8 is formed between the two substrates. As shown in FIG. 13, a plurality of column electrodes 6 are provided on the inner surface of the rear glass substrate 5 in a manner such that they are all orthogonal to the row electrode pairs 2,2. In fact, intersections of the row electrode pairs 2,2 with the column electrodes 6 form picture element cells. Further, a plurality of strap-like partitions 9 are provided between the column electrodes 6, so that the discharge space 8 is divided into several sections. Inaddition, a plurality of elongated fluorescent layers 7 are disposed in the discharge space 8 to cover the column electrode 6 and side walls of the partitions 9. Finally, after noble gas is sealed into the discharge space 8, a plasma display panel is thus formed.

In use of the surface discharge type plasma display panel constructed as shown in FIGS. 12–14, at first, an addressing process is conducted by selective discharges between the column electrodes 6 and the row electrodes 2, so as to select lighting cells (in which wall charges are formed) and not-lighting cells (in which wall charges are not formed). After the addressing process, by alternatively applying discharge maintaining pulses to the row electrode pairs 2,2 on all the display lines L, a surface discharge will occur every time the discharge maintaining pulses are applied to the lighting cells. Then, with the effect of the surface discharge, an ultraviolet light will occur, so that the elongated fluorescent layers 7 are excited, thereby producing a visible light.

Conventionally, in order to improve a contrast and a color fineness of a surface discharge type plasma display panel, a plurality of strap-like inorganic pigment layers 41R, 41G, 41B are usually provided on the inner surface of the front glass substrate 1 by virtue of screen printing.

However, if several inorganic pigment layers 41R, 41G, 41B are disposed on the inner surface of a front glass substrate 1, these color filters 41 are difficult to be made uniform in their thickness, because different color filter layers are usually manufactured with different requirements and have different optical characteristics. Moreover, as shown in FIG. 14, since the pigment layers 41R, 41G, 41B are formed into strap-like shape, there are formed some convex and concave portions (irregularities) on the surface of the protection layer 4. To eliminate such irregularities, an overcoat layer 42 is often formed to cover up these pigment layers 41, but still fails to obtain a smooth and flat surface, unavoidably producing some convex-concave portions of several microns.

On the other hand, if the metal layers forming the metal electrodes 2*b* are made of a silver paste forming into a coating layer having a thickness of several micron, there will also form some convex and concave portions (irregularities) on the surface of the protection layer 4, as shown in FIG. 13. As a result, some undesired gaps will be undesirably formed between the partition walls 9 and the protection layers 4, resulting in a problem that a discharge in one cell will undesirably spread to an adjacent cell through such gaps, hence causing a wrong discharge.

SUMMARY OF THE INVENTION

It is an object of the present invention to provide an improved plasma display panel in which an overcoat layer is firmly fixed in position with an improved adherence, so as to obtain an improved reliability for the plasma display panel, thereby solving the above-mentioned problems peculiar to the above-mentioned prior arts.

It is another object of the present invention to provide an improved plasma display panel in which color filter layers (inorganic pigment layers) are provided in a manner such that the contrast and the color fineness of the plasma display panel may be improved and that a possible wrong discharge may be prevented, so as to obtain an improved reliability for the plasma display panel, thereby solving the above-mentioned problems peculiar to the above-mentioned prior arts.

According to the present invention, there is provided a plasma display panel comprising: a front substrate plate providing a display surface; a plurality of row electrode pairs formed on an inner surface of the front substrate plate; each row electrode pair having a plurality of discharge gaps, with each discharge gap located within a unit luminescent area; a dielectric layer formed on the plurality of row electrode pairs; a protection layer formed on the dielectric layer; a rear substrate plate spaced apart from the front substrate plate with a discharge space formed therebetween; a plurality of column electrodes formed on an inner surface of the rear substrate layer, said column electrodes being arranged in a direction orthogonal to the row electrode pairs; a plurality of elongated partitions disposed between the plurality of column electrodes; a plurality of elongated fluorescent layers covering the column electrodes and side walls of the elongated partitions; a plurality of color filter layers formed on the inner surface of the front substrate plate, said color filter layers being provided corresponding to the elongated fluorescent layers. In particular, the color filter layers are inorganic pigment layers patterned in a manner such that one or more unit luminescent areas contains one of the color filter layers just like an isolated island.

In one aspect of the present invention, the inorganic layers are interposed between the front substrate plate and the row electrodes, a transparent overcoat layer is formed on the inorganic pigment layers.

In another aspect of the present invention, the inorganic pigment layers are disposed between the row electrodes and the dielectric layer, or disposed within the dielectric layer, or alternatively disposed between the dielectric layer and the protection layer.

In a further aspect of the present invention, each row electrode includes a plurality of transparent electrodes and a metal electrode, said metal electrode being formed to overlap a plurality of strap-like areas not forming inorganic pigment layer in the extending direction of the column electrodes.

In a still further aspect of the present invention, the strap-like areas not forming the inorganic pigment layer are overlapped by a light-blocking material.

In addition, according to the present invention, there is provided another plasma display panel comprising: a front substrate plate providing a display surface; a plurality of row electrode pairs formed on an inner surface of the front substrate plate, each row electrode pair consisting of transparent conductive electrode and metal electrode; a dielectric layer formed on the plurality of row electrode pairs; a protection layer formed on the dielectric layer; a rear substrate plate spaced apart from the front substrate plate with a discharge space formed there between; a plurality of column electrodes formed on an inner surface of the rear substrate layer, said column electrodes being arranged in a direction orthogonal to the row electrode pairs; a plurality of elongated partitions disposed between the plurality of column electrodes; a plurality of elongated fluorescent layers covering the column electrodes and side walls of elongated partitions; a plurality of color filter layers formed on the inner surface of the front substrate plate, said color filter layers being formed corresponding to the plurality of elongated fluorescent layers. In particular, the color filter layers are inorganic pigment layers formed into a plurality of isolated island-like pieces not overlapping metal electrodes, the metal electrodes are located between the color filter layers in a manner such that the metal electrodes and the color filter layers are substantially formed into an identical layer.

In one aspect of the present invention, a plurality of island-like light-blocking layers are provided between the color filter layers, with their longitudinal axes arranged in the extending direction of the column electrodes.

In another aspect of the present invention, between the inorganic pigment layers there are formed a plurality of grooves each having a predetermined width, arranged in the extending direction of the row electrodes, the above metal electrodes are buried in these grooves.

The above objects and features of the present invention will become better understood from the following description with reference to the accompanying drawings.

DETAILED DESCRIPTION OF THE PREFERRED EMBODIMENTS

Figure 1:
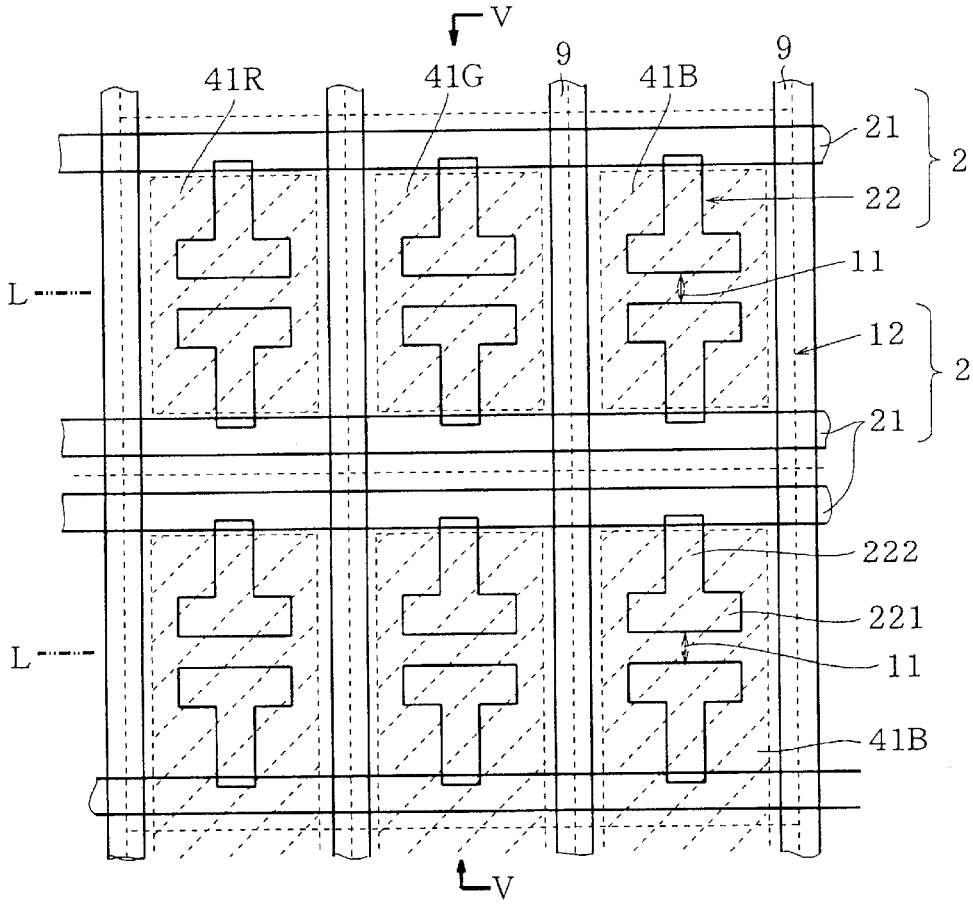
FIG. 1 is a plane view indicating a plasma display panel made according to a first embodiment of the present invention.

In the following description of preferred embodiments of the present invention, the elements which are the same as those used in the above prior arts will be represented by the same reference numerals, and similar descriptions thereof will be omitted.

Figure 2:
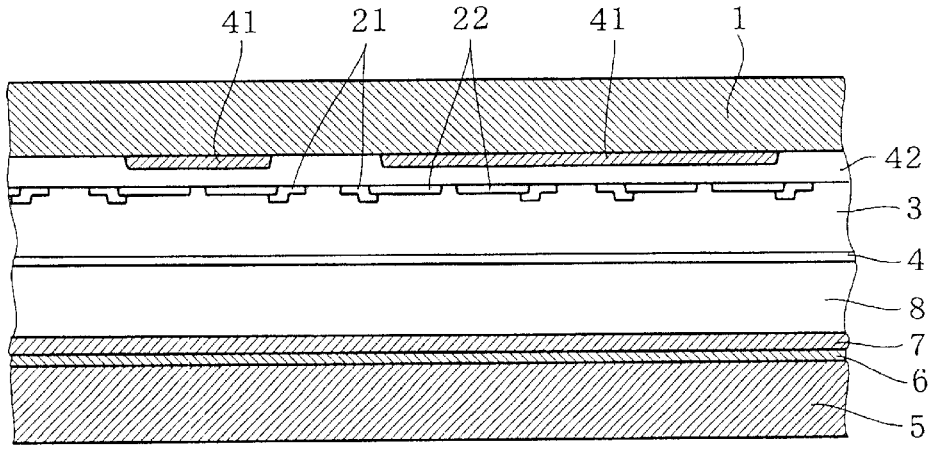
FIG. 2 is a cross sectional view taken along a section line V—V in FIG. 1.

FIGS. 1 and 2 indicate a surface discharge type plasma display panel made according to a first embodiment of the present invention.

FIG. 1 is an enlarged plane view indicating the plasma display panel. Referring to FIG. 1, each pair of row electrodes 2,2 include two elongated main body portions 21, 21 which are elongated strap-like members arranged in parallel with display lines L, a plurality of projection pairs 22,22. Each projection pair 22,22 are arranged facing each other to form a discharge gap 11 therebetween. Each projection 22 includes a wide-width portion 221 and a narrow-width portion 222. In detail, each projection 22 is formed by a transparent electrode consisting of a T-shaped transparent conductive film, and is overlapped with an elongated main body portion 21 formed by a metal electrode consisting of a metal film.

Formed on the inner surface of a front glass substrate plate 1 (providing a display surface), are a plurality of inorganic pigment layers 41R, 41G, 41B serving as color filter layers. Each of the inorganic pigment layers 41R, 41G, 41B presents a rectangular configuration and is arranged in a direction orthogonal to the extending direction of the row electrodes 2. In detail, the inorganic pigment layers 41R, 41G, 41B are provided corresponding to a plurality of elongated fluorescent layers 7 (7R, 7G, 7B) provided on the inner surface of a rear glass substrate 5, in a manner such that one or more unit luminescent areas 12 contains one of the inorganic pigment layers (color filter layers) just like an isolated island. As a result, there are existing a plurality of strap-like areas not forming the inorganic pigment layers 41 in the extending direction of the row electrodes 2, and a plurality of strap-like areas not forming the inorganic pigment layers 41 in the extending direction of column electrodes 6 (FIG. 2). In particular, a plurality of strap-like areas not forming inorganic pigment layers 41 in the extending direction of the column electrodes 6 are overlapped by elongated main body portions 21 (formed by metal electrodes consisting of a metal film) of the row electrodes 2.

FIGS. 2 is a cross sectional view indicating the internal structure of the plasma display panel of FIG. 1. In detail, FIG. 2 is a cross sectional view taken along a section line V—V in FIG. 1. In fact, the plasma display panel of the present embodiment is an AC-driven surface discharge type plasma display panel.

Referring to FIG. 2, formed on the inner surface of a front glass substrate plate 1 (providing a display surface), are a plurality of inorganic pigment layers 41 including the color filter layers 41R, 41G, 41B (FIG. 1). A transparent overcoat 42 is formed covering the inorganic pigment layers 41, a plurality of row electrode pairs 2,2 are formed on the transparent overcoat 42. Further, a dielectric layer 3 is formed to cover up the row electrode pairs 2,2, a protection layer 4 consisting of magnesium oxide (MgO) is formed to cover the dielectric layer 3.

On the other hand, a rear glass substrate plate 5 is positioned spaced apart from the front glass substrate plate 1 so that a discharge space 8 is formed between the two substrate plates. Further, a plurality of elongated strap-like partitions 9 are provided on the inner surface of the rear glass substrate plate 5, so that the discharge space 8 is divided into a plurality of unit luminescent areas 12 along the direction of the display lines L. As shown in FIG. 2, a plurality of column electrodes 6 are provided on the inner surface of the rear glass substrate plate 5 in a manner such that they are all orthogonal to the row electrodes 2. In addition, a plurality of elongated fluorescent layers 7 (7R, 7G, 7B) are disposed in the discharge space 8 to cover the column electrodes 6 and the side walls of the elongated partitions 9.

In this way, since there are existing a plurality of strap-like areas not forming the inorganic pigment layers 41 in the extending direction of the row electrodes 22, and a plurality of strap-like areas not forming the inorganic pigment layers 41 in the extending direction of the column electrodes 6, the front glass substrate 1 and the overcoat layer 42 are allowed to be firmly combined together through these strap-like areas which are surely sufficient to hold the two members together with an increased adherence.

In this way, even if some pin holes or cracks occur in the overcoat layer 42, it is allowed to prevent the overcoat layer 42 from peeling off the inner surface of the front glass substrate 1 and minimize any possible discoloration in the overcoat layer 42. Further, even if strap-like areas (not forming the inorganic pigment layers 41 in the extending direction of the column electrodes 6) are different in their width from place to place due to patterning deflection in forming the pigment layers 41, the front glass substrate 1 and the overcoat layer 42 are allowed to be combined together through sufficient contact areas with an increased adherence.

Figure 3:
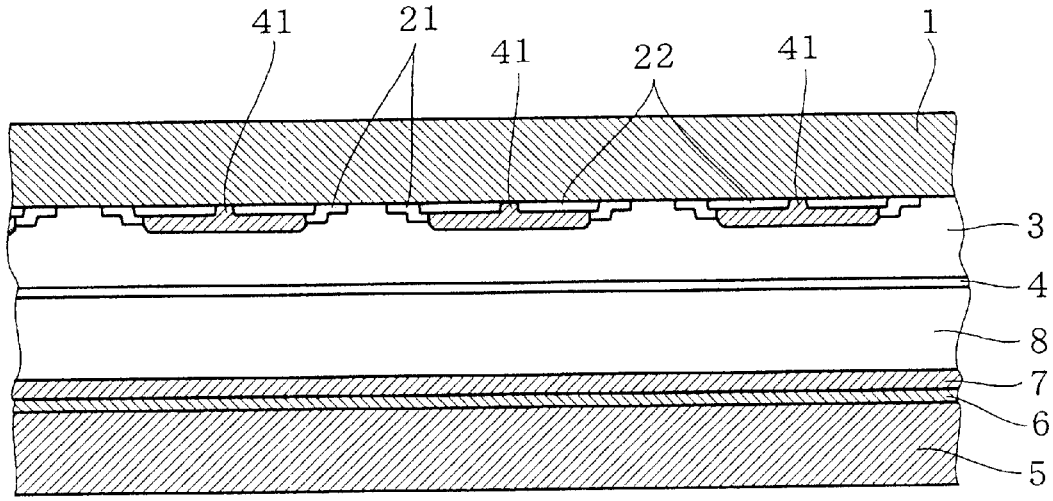
FIG. 3 is a cross sectional view indicating a plasma display panel made according to a second embodiment of the present invention.

FIG. 3 is a cross sectional view indicating a plasma display panel made according to a second embodiment of the present invention. In this embodiment, inorganic pigment layers 41 (constituting color filter layers) are formed between the row electrodes 2 and the dielectric layer 3. Further, although not shown in the drawings, it is also possible that the inorganic pigment layers 41 (constituting color filter layers) may be formed within the dielectric layer 3, or alternatively it may be formed between the dielectric layer 3 and the protection layer 4.

In addition, it is also allowable that a light-blocking material such as a black pigment material may be used to form black strap layers or black matrix layers in a manner so as to overlap the strap-like areas not forming the inorganic pigment layers 41. Further, such light-blocking material layer may be formed into a layer different from the inorganic pigment layers 41, or may be formed integrally with the inorganic pigment layers 41.

FIGS. 4–7 are views schematically illustrating a surface discharge type plasma display panel, made according to a third embodiment of the present invention.

Figure 4:
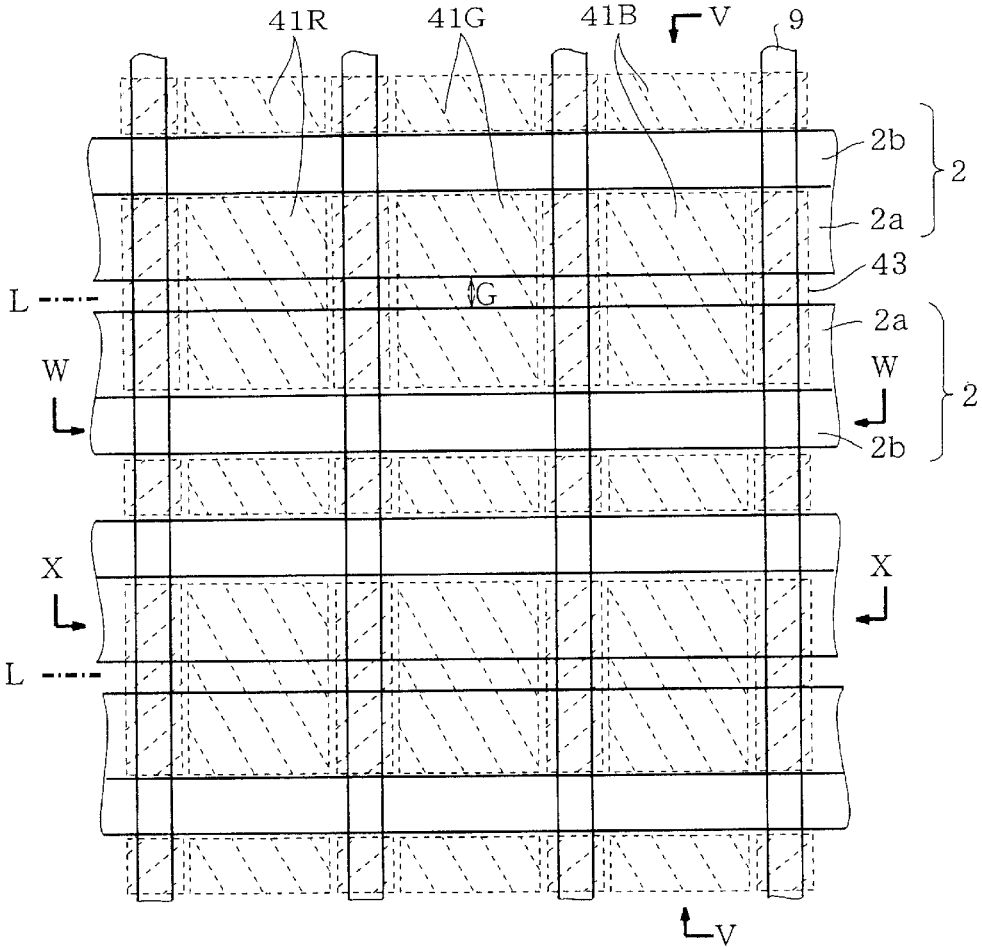
FIG. 4 is a plane view indicating a plasma display panel made according to a third embodiment of the present invention.

As shown in FIG. 4, a plurality of row electrode pairs 2, 2 are provided and arranged in a manner such that each pair forms a discharge gap G on each display line L. Along each display line L, there are formed several unit luminescent areas each serving as a picture element cell (discharge sell), at intersections where the row electrodes 2 are intersected with column electrodes 6 (FIGS. 5 and 6).

Each row electrode 2 includes a transparent electrode 2*a* consisting of a strap-like transparent conductive film having a relatively large width, and a metal electrode (bus electrode) 2*b* consisting of a metal film having a relatively small width. The metal electrode 2*b* is used to supplement the conductivity of the transparent electrode 2*a*. In practice, the metal electrode 2*b* is a silver paste coating layer having a thickness of several microns, positioned opposite to the discharge gap G.

Figure 7:
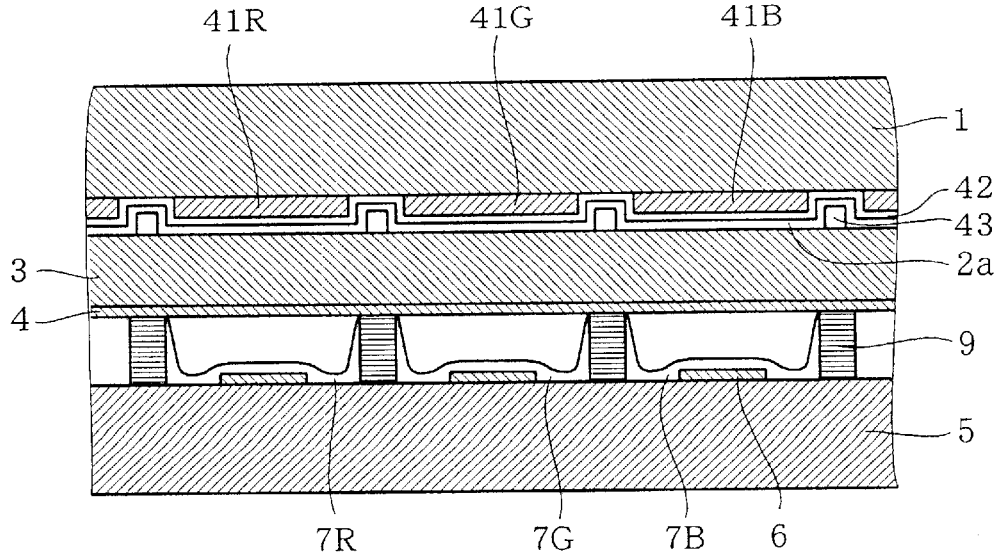
FIG. 7 is a cross sectional view taken along a section line x—x in FIG. 4.

A plurality of inorganic pigment layers 41R, 41G, 41B (forming color filter layers), are provided on the inner surface of the front glass substrate 1, corresponding to a plurality of elongated fluorescent layers 7 (7R, 7G, 7B, as shown in FIG. 7). In detail, the inorganic pigment layers 41R, 41G, 41B are formed into rectangular shapes arranged orthogonal to the row electrodes 2, but not overlapping the metal electrodes 2*b*, thereby forming a plurality of isolated island-like pieces. Further, a plurality of island-like light-blocking layers 43 are formed between the inorganic pigment layers 41R, 41G, 41B.

Figure 5:
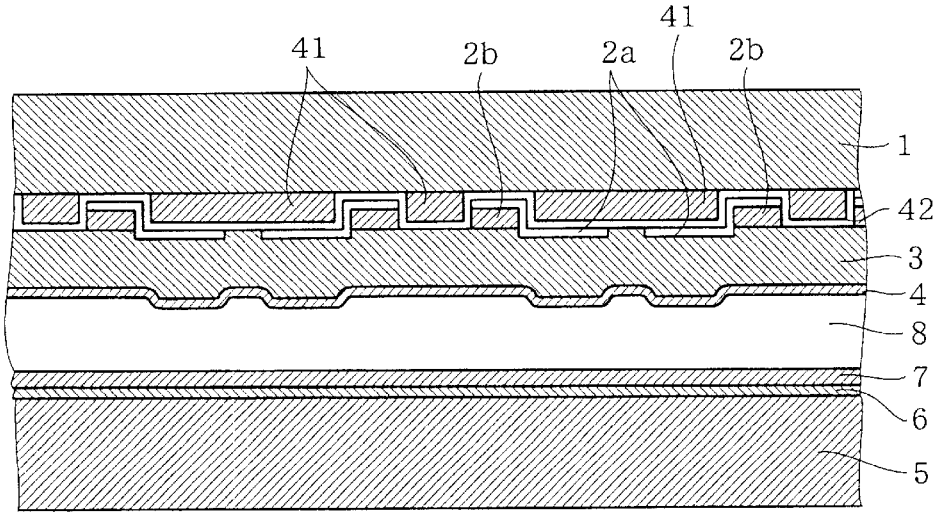
FIG. 5 is a cross sectional view taken along a section line V—V in FIG. 4.
Figure 6:
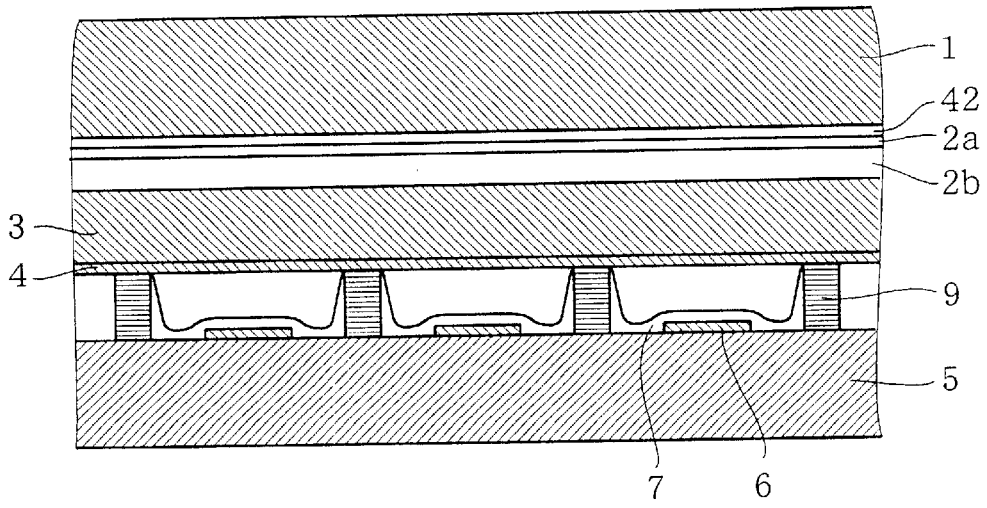
FIG. 6 is a cross sectional view taken along a section line W—W in FIG. 4.

FIG. 5 is a cross sectional view taken along a section line V—V in FIG. 4, schematically indicating the internal structure of the plasma display panel of FIG. 4. As shown in Figs. 4 and 5, formed on the inner surface of a front glass substrate 1, are a plurality of inorganic pigment layers 41 forming color filter layers, a transparent overcoat 42 covering the inorganic pigment layers 41, a plurality of row electrode pairs 2,2, a dielectric layer 3 covering the row electrode pairs 2,2, a protection layer 4 consisting of MgO for covering the dielectric layer 3.

On the other hand, a rear glass substrate 5 is positioned spaced apart from the front glass substrate 1 so that a discharge space 8 is formed between the two substrates. As shown in FIG. 5, a plurality of column electrodes 6 are provided on the inner surface of the rear glass substrate 5 in a manner such that they are all orthogonal to the row electrode pairs 2,2. In fact, the intersections of the row electrode pairs 2,2 with the column electrodes 6 form picture element cells. Further, a plurality of strap-like partitions 9 are provided between the column electrodes 6, so that the discharge space 8 is divided into several sections. In addition, a plurality of elongated fluorescent layers 7 are disposed in the discharge space 8 to cover the column electrode 6 and the side walls of the partitions 9. Finally, after a noble gas is sealed into the discharge space 8, a plasma display panel is thus formed.

Figure 13:
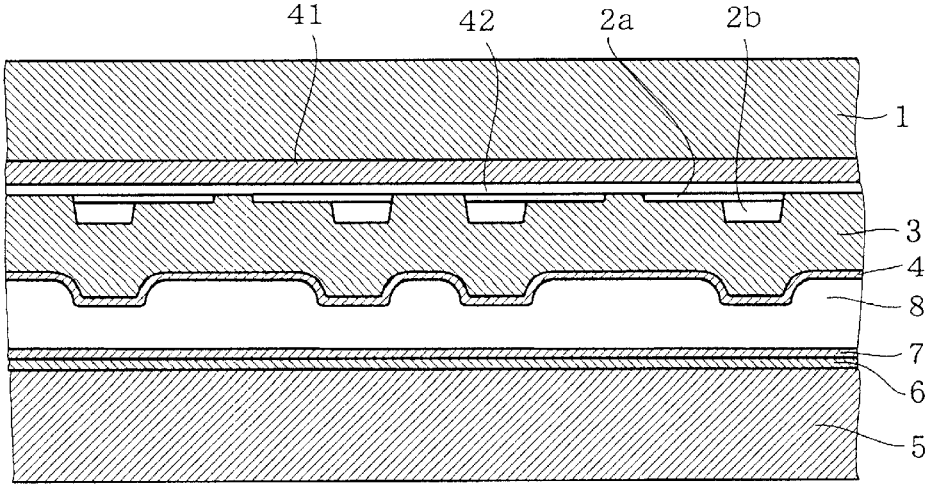
FIG.13 PRIOR ART
FIG. 13 is a cross sectional view taken along a section line V—V in FIG. 12.
Figure 14:
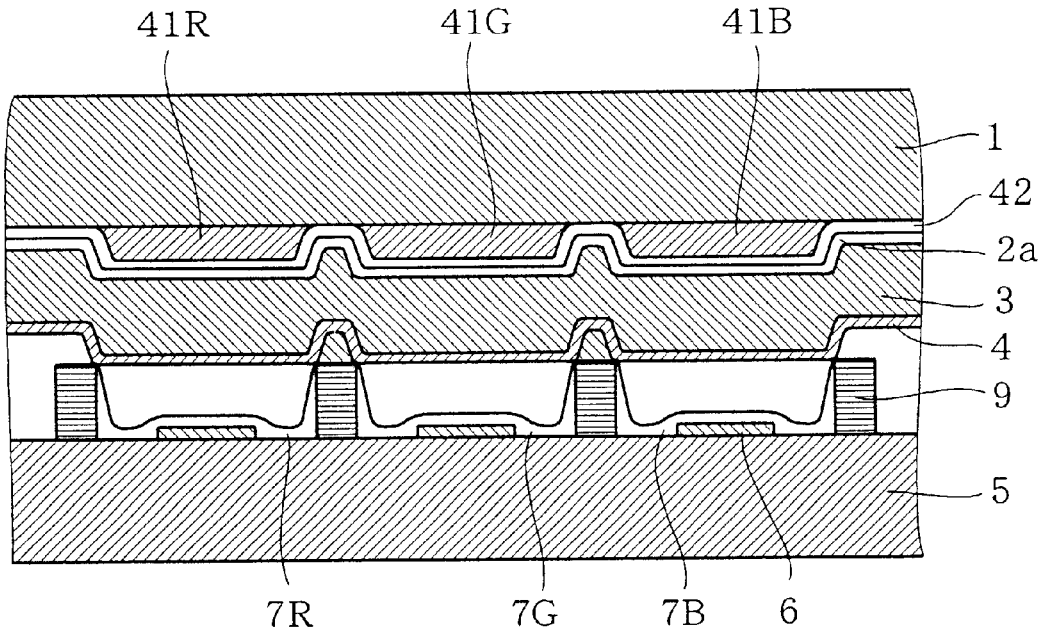
FIG.14 PRIOR ART
FIG. 14 is a cross sectional view taken along a section line W—W in FIG. 12.

In the plasma display panel of the third embodiment, the inorganic pigment layers 41 are each formed into a rectangular shape, further, as shown in FIG. 5, between the inorganic pigment layers 41 there are formed grooves each having a predetermined width, arranged in the extending direction of the row electrodes 2. In fact, the above metal electrodes 2*b* are buried in these grooves. In this way, as shown in FIGS. 5 and 6, convex-concave phenomenon on the protection layer 4 are reduced when compared with a condition shown in FIG. 13. Further, as shown in FIGS. 4 and 7, since a plurality of light-blocking black straps 43 are provided between the inorganic pigment layers 41, it is allowed not only to inhibit external light reflecting, but also to reduce irregularities which are otherwise caused by the formation of the inorganic pigment layers 41.

Figure 8:
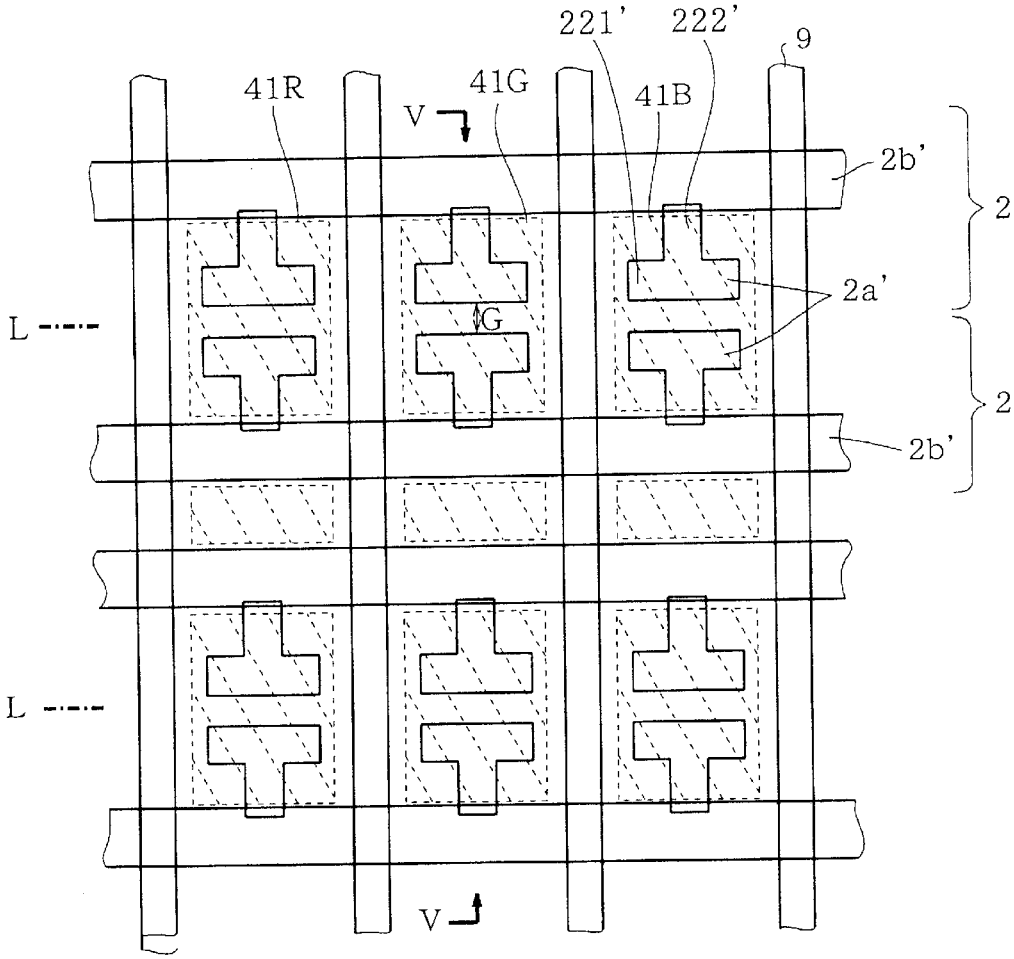
FIG. 8 is a plane view indicating a plasma display panel made according to a fourth embodiment of the present invention.
Figure 9:
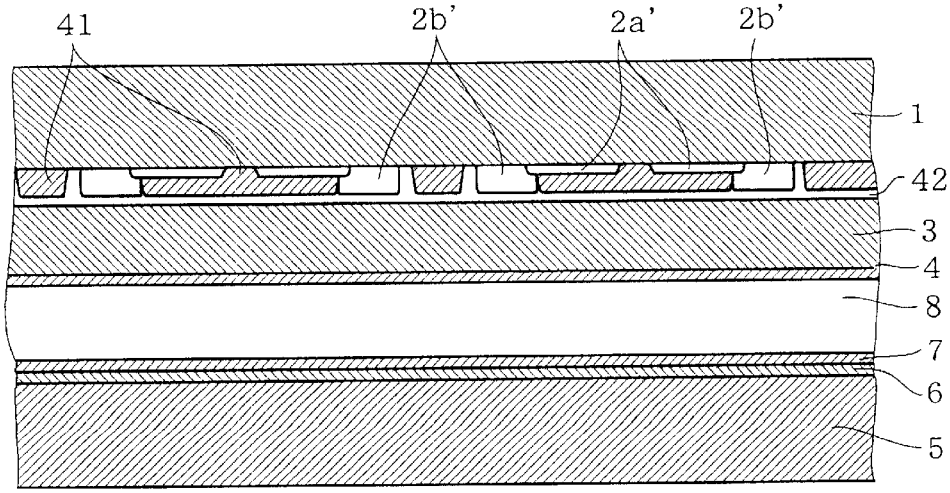
FIG. 9 is a cross sectional view taken along a section line V—V in FIG. 8.
Figure 10:
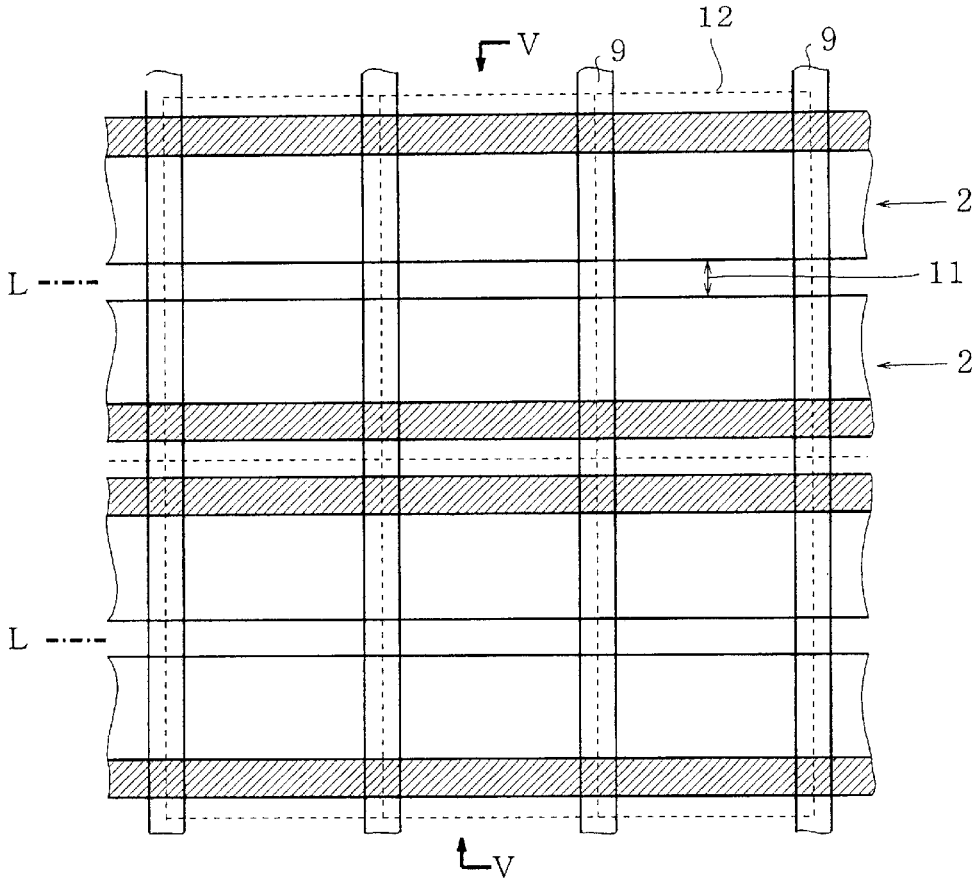
FIG.10 PRIOR ART
FIG. 10 is a plane view indicating a plasma display panel made according to a prior art.
Figure 11:
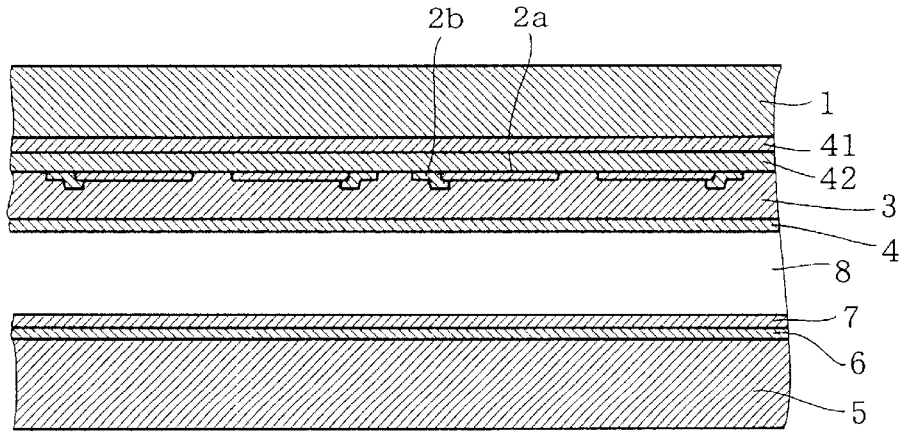
FIG.11 PRIOR ART
FIG. 11 is a cross sectional view taken along a section line V—V in FIG. 10.
Figure 12:
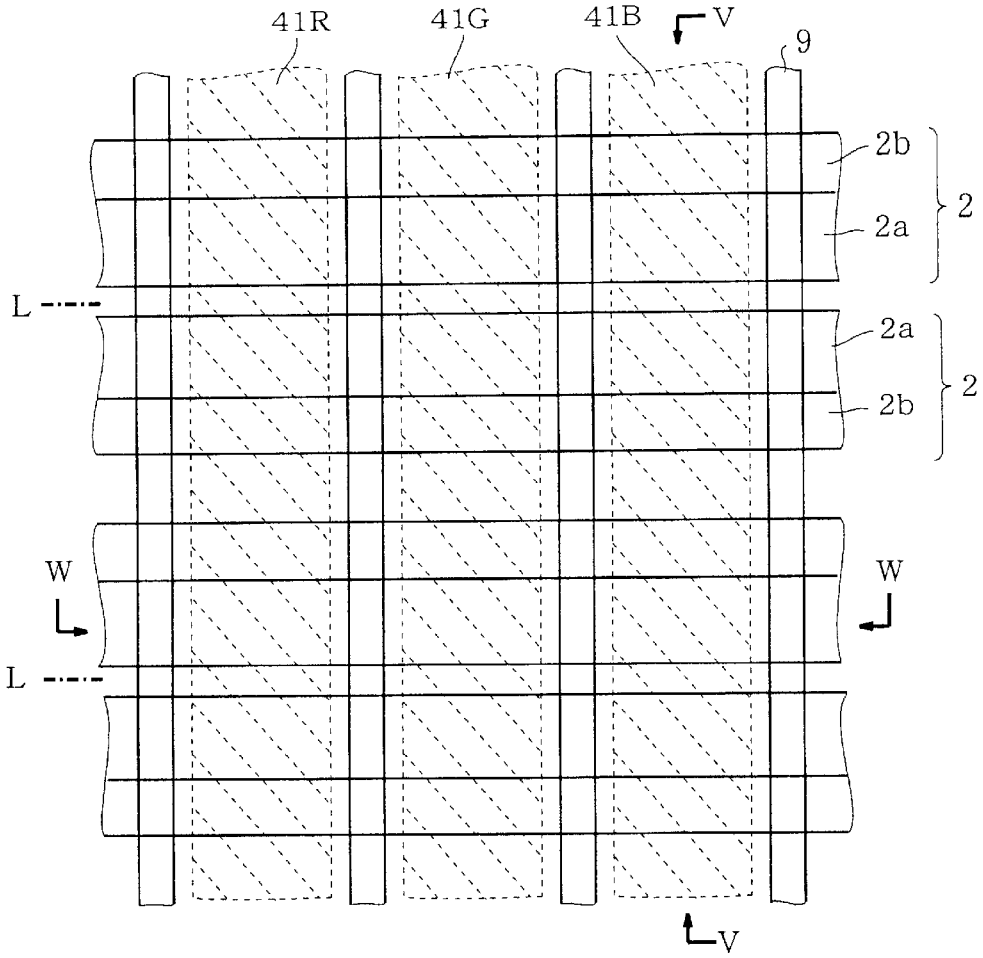
FIG.12 PRIOR ART
FIG. 12 is a plane view indicating another plasma display panel made according to a prior art.

FIGS. 8 and 9 are views schematically illustrating a surface discharge type plasma display panel, made according to a fourth embodiment of the present invention.

As shown in FIG. 8 which is a plane view, each pair of row electrodes 2,2 include two metal electrodes 2*b*', 2*b*' which are elongated strap-like members arranged in parallel with display lines L, several pairs of transparent electrodes 2*a*', 2*a*' consisting of transparent conductive film. Each pair of transparent electrodes 2*a*', 2*a*' are arranged facing each other to form a discharge gap G therebetween. Each transparent electrode 2*a*' includes a wide-width portion 221' and a narrow-width portion 221'. In fact, each transparent electrode 2*a*' consists of a T-shaped transparent conductive film, and is overlapped on metal electrodes 2*b*' in a manner such that they are electrically connected with each other.

Similar to the above third embodiment, a plurality of inorganic pigment layers 41 (forming color filter layers) including layers 41R, 41G, 41B, are provided on the inner surface of the front glass substrate 1. In detail, the inorganic pigment layers 41R, 41G, 41B are formed into rectangular shape arranged in a direction orthogonal to the row electrodes 2, but not overlapping the metal electrodes 2*b*, thereby forming a plurality of isolated island-like pieces.

As shown in FIG. 9 which is a cross sectional view taken along a section line V—V in FIG. 8, a transparent overcoat layer 42 is formed to cover the inorganic pigment layers 41, a dielectric layer 3 is formed on the overcoat layer 42, a protection layer 4 consisting of magnesium oxide (MgO) is formed on the dielectric layer 3.

On the other hand, a rear glass substrate plate 5 is positioned spaced apart from the front glass substrate plate 1 so that a discharge space 8 is formed between the two substrate plates. Further, a plurality of elongated strap-like partitions 9 are provided on the inner surface of the rear glass substrate plate 5, so that the discharge space 8 is divided into a plurality of unit luminescent areas 12 along the direction of the display lines L. As shown in FIG. 9, a plurality of column electrodes 6 are provided on the inner surface of the rear glass substrate plate 5 in a manner such that they are all orthogonal to the row electrodes 2. In addition, a plurality of elongated fluorescent layers 7 are disposed in the discharge space 8 to cover the column electrodes 6 and the side walls of the elongated partitions 9.

The differences between the third embodiment and the fourth embodiment may be concluded as follows. Namely, the inorganic pigment layers 41 are formed on the row electrodes 2, each transparent electrode 2*a*' made of a transparent conductive film is isolated within a unit luminescent area. In particular, the inorganic pigment layers 41 are formed into a plurality of rectangular pieces, a plurality of elongated grooves (not forming the inorganic pigment) are formed between the inorganic pigment layers 41 in the extending direction of the row electrodes, each groove is filled with an elongated metal electrode 2*b*', so that it is allowed to reduce irregularities (convex-concave portions) caused due to the metal electrodes 2*b*. Further, since each transparent electrode 2*b*' is isolated within each unit luminescent area, even if there is a possibility that a gap will occur between a partition wall 9 and the protection layer 4, it is allowed to prevent an electrical discharge from spreading to adjacent cells by way of such gaps.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A plasma display panel comprising:

a front substrate plate providing a display surface;

a plurality of row electrode pairs formed on an inner surface of the front substrate plate; each row electrode pair having a transparent conductive electrode and a metal electrode;

a dielectric layer formed on the plurality of row electrode pairs;

a protection layer formed on the dielectric layer;

a rear substrate plate spaced apart from the front substrate plate with a discharge space formed therebetween;

a plurality of column electrodes formed on an inner surface of the rear substrate plate, said column electrodes being arranged in a direction orthogonal to the row electrode pairs;

a plurality of elongated partitions disposed between the plurality of column electrodes;

a plurality of elongated fluorescent layers covering the column electrodes and the side walls of the elongated partitions;

a plurality of color filter layers formed on the inner surface of the front substrate plate, said color filter layers being formed corresponding to the plurality of elongated fluorescent layers;

wherein the color filter layers are inorganic pigment layers formed into a plurality of isolated island-like pieces not overlapping the metal electrodes, the metal electrodes are located between the color filter layers in a manner such that the metal electrodes and the color filter layers are formed at an identical layer level, and wherein the color filter layers are formed into a plurality of isolated island-like pieces in a manner such that each piece of the color filter layer corresponding to one sort of color is separated from its surrounding pieces of color filters layers.

2. The plasma display panel according to claim 1, wherein a plurality of island-like light-blocking layers are provided between the color filter layers, with their longitudinal axes arranged in the extending direction of the column electrodes.

3. The plasma display panel according to claim 1, wherein between the inorganic pigment layers there are formed a plurality of grooves each having a predetermined width, arranged in the extending direction of the row electrodes, the above metal electrodes are buried in these grooves.

* * * * *